US005238014A

United States Patent [19]

Cai

[11] Patent Number: 5,238,014

[45] Date of Patent: Aug. 24, 1993

[54] BACKBONE-TYPE FRAMEWORK FOR TENTS OR HOUSES

[75] Inventor: Yongsheng Cai, Shenyang, China

[73] Assignee: China Shenyang Damo Camp Equipment Institute, Shenyang, China

[21] Appl. No.: 637,048

[22] Filed: Jan. 3, 1991

[30] Foreign Application Priority Data

Jan. 12, 1990 [CN] China ..... 90100056

[51] Int. Cl.[5] ..... E04H 15/36

[52] U.S. Cl. ..... 135/102; 135/106; 135/906; 403/160; 405/288

[58] Field of Search ..... 135/87, 102, 106, 906, 135/109, 909; 52/89; 405/288; 403/160; 285/114, 157

[56] References Cited

U.S. PATENT DOCUMENTS

| | | | |
|---|---|---|---|
| 2,948,047 | 8/1960 | Peeler | 135/906 X |
| 3,240,217 | 3/1966 | Bird et al. | 135/906 X |
| 3,448,748 | 6/1969 | Walrave | 135/106 X |
| 4,095,433 | 6/1978 | Yamamoto et al. | 405/288 |
| 4,284,094 | 8/1981 | Behrend | 135/102 |

FOREIGN PATENT DOCUMENTS

| | | | |
|---|---|---|---|
| 1183642 | 12/1964 | Fed. Rep. of Germany | 135/102 |
| 1204688 | 1/1960 | France | 135/102 |
| 1508202 | 1/1968 | France | 52/89 |

*Primary Examiner*—David A. Scherbel
*Assistant Examiner*—Lan Mai
*Attorney, Agent, or Firm*—David H. Semmes

[57] ABSTRACT

A backbone-type framework for tents or houses, comprising a rope, a plurality of backbone links connected in series by said rope; a hand winch located at one end of said framework to tension or release the rope; a rope-reverser located at the other end of said framework; each of the backbone links comprises a tube link and two end caps, said end cap has tube portion and an end plate, said tube portion can be inserted into said tube link, said end plate has two holes, the outer end surface of said end plate is oblique.

9 Claims, 4 Drawing Sheets

BACKBONE-TYPE FRAMEWORK FOR TENTS OR HOUSES

The present invention relates to a backbone-type framework for tents or houses.

In general, tents are supported by frameworks made from metal or wood, or supported by umbrella-shaped framework. These frameworks have the common disadvantages that the inner space utilization of tents is poor, and elements of the frameworks are so heavy that they are difficult to be assembled, disassembled, and transported. Moreover, the amount of the framework elements are overmuch so that they tend to be damaged or lost during operation or transport. Recently, a new kind of tent with inflatable ribs has been developed, although the inflatable tent has a great improvement as compared with the traditional tents, the inflatable ribs of the tent have to be inflated before its use, and during the use of the tent, supplemental air has to be supplied to the inflatable ribs of the tent, thus, the power supply and the air-compressor are necessary for inflating or supplemental inflating, therefore, the application scope of the inflatable tent is greatly limited.

The object of the present invention is to provide a backbone-type framework which may be widely employed for tents, dismountable houses or some permanent constructions. Said backbone-type framework has the following advantages: the tent using said framework has a good space utility and a simple structure, it is convenient to assemble (or disassemble) the tent, and the elements of the tent are light and small.

The object of the present invention is achieved by providing a new backbone-type framework, said backbone-type framework comprises a rope, a plurality of backbone links connected in series by said rope; a hand winch located at one end of the framework, said rope is connected to the hand winch and can be tensioned or released; a rope-reverser located at the other end of said framework; each of said backbone links comprises a tube link and two end caps, said end cap has a tube portion and an end plate, the outer diameter of said tube portion is equal to the inner diameter of the tube link, so that the tube portion can be inserted into the tube link. The outer end surface of the end plate is oblique, thus there is an angle between two end surfaces of the end plate, the frameworks of various shapes can be formed by choosing said angle between the two end surfaces.

The backbone-type framework of the present invention will be further described by referring to the following drawings.

FIGS. 9–14 are schematic views of a shape of a tent according to the present invention.

Figure 1:
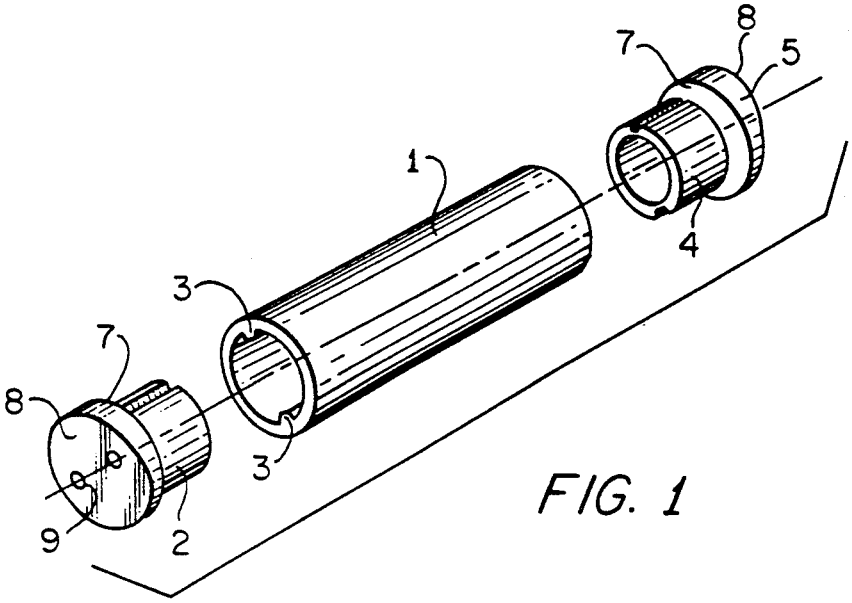
FIG. 1 is a perspective view of the backbone link according to the present invention.
Figure 2:
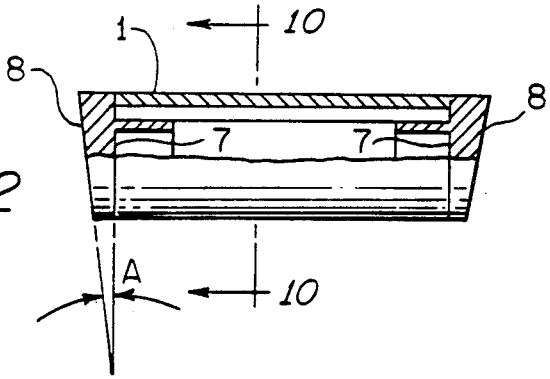
FIGS. 2 and 10 are sectional views of the assembled backbone link.
Figure 10:
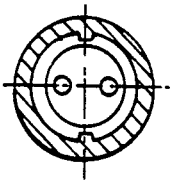
Figure 5:
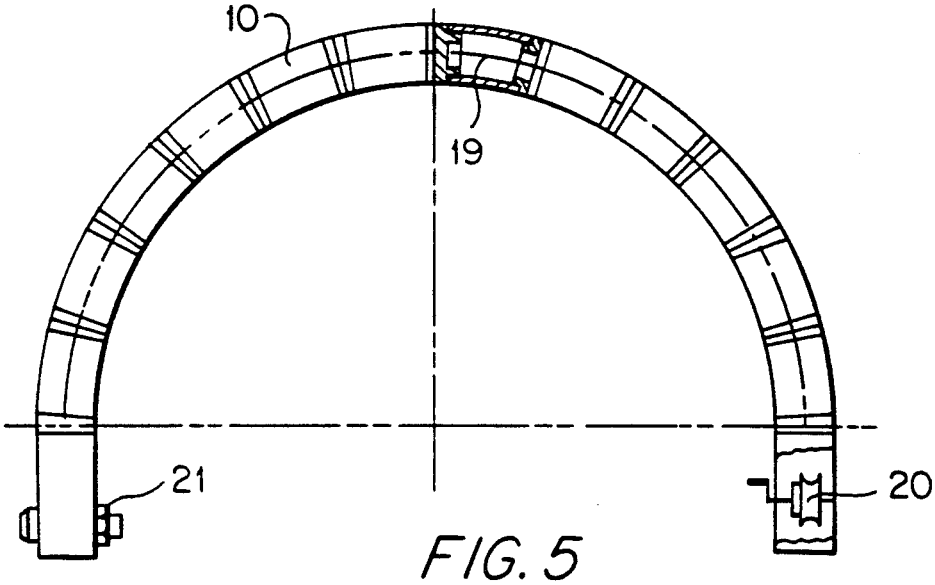
FIG. 5 is a schematic view of a single assembled framework.

First referring to FIGS. 1, 2 and 5, the backbone-type framework (18) comprises a plurality of backbone links (10), each of the backbone links (10) consists of a tube link (1) and two end caps (2), the tube link (1) is shaped as a tube, and may be made from any suitable material, such as moulded polypropylene. The tube link (1) is provided on its inner wall with two protrusion portions (3) extending axially along the axial direction of the tube link (1), the two protrusion portions (3) are spaced from each other at an angle of 180°. The end cap (2) may be made from any suitable material, such as mounded ABS; the end cap (2) has a tube portion (4) and a circular end plate (5) which closes one end of said tube portion (4), the circular end plate (5) has an outer diameter equal to the outer diameter of the tube link (1), the inner end surface (7) of the end plate (5) is perpendicular to the axis of the tube portion (4), the outer end surface (8) of the end plate (5) is oblique relative to the axis of the tube portion (4), thus an angle A is formed between the inner end surface (7) and the outer end surface (8). (Said angle A will be further described below). The end plate (5) is provided with two holes (9) through which a rope (19) passes, the two holes (9) are spaced from each other at an angle of 180°. The tube portion (4) of the end cap (2) has an outer diameter equal to the inner diameter of the tube link (1). The tube portion (4) is provided with two grooves (11) extending axially along the axial direction of the tube portion (4), said two grooves (11) are spaced from each other at an angle of 180°, the grooves (11) can engage with the protrusion portions (3) of the tube link (1) when the tube portion (4) is inserted into the tube link (1). Said two grooves are positioned at right angle with the two holes (9) of the end plate (5). When the backbone link (10) is assembled, the tube portions (4) of the two end caps (2) are inserted into the tube link (1), the protrusion portions (3) are received within the grooves (11), and the inner end surfaces (7) of the two end plates (5) contact with the end surfaces of the tube link (1), thus a tight fitting is produced between the tube link (1) and the two end caps (2).

The two axial protrusion portions (3) of the tube link (1) possess two effects: (a) To improve the rigidity and the strength of the tube link (1). (b). To determine the relative position between the tube link (1) and the end cap (2), so that the holes (9) through which the rope (19) passes and the tube link (1) can be positioned from each other.

Figure 3:
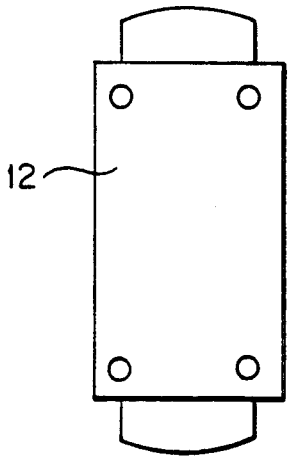
FIGS. 3 and 15 are sectional views of another embodiment according to the present invention, showing a backbone link with a flange.
Figure 15:
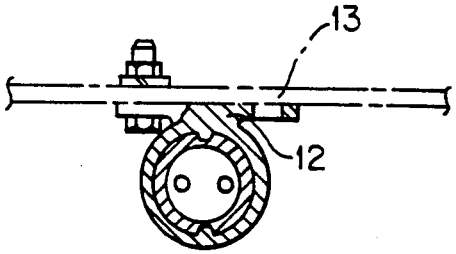

FIG. 3 shows another embodiment of the backbone link (10) according to the present invention, in which, each of the tube links is provided with a flange (12). The flat surface of the flange (12) is perpendicular to the protrusion portions (3) on the inner wall of the tube link (1). The flange (12) is provided with holes, so that the tube link can be fixed to a rigid roof (13) by means of bolts, thus, the flanged tube link can be employed for dismountable houses or some permanent constructions. The other portions of the backbone link are similar to those of the backbone link (10) shown in FIG. 1.

Figure 4:
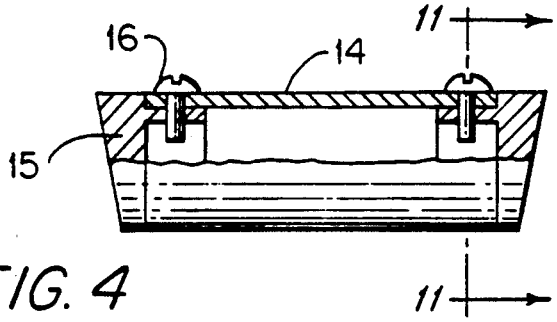
FIG. 4 is a sectional view of a further embodiment according to the present invention, showing the structure of the metallic backbone link.
Figure 11:
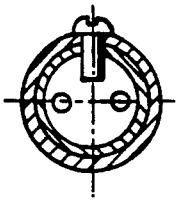

FIG. 4 shows a further embodiment of the backbone link according to the present invention, in which, both the tube link (14) and the end cap (15) are made from metal, for example, the tube link (14) may be made from steel pipe or aluminum-alloy pipe, and the end cap (15) may be made from steel, alloy steel or aluminum-alloy.

The tube link (14) and the tube portion of the end cap (15) are respectively provided with holes, so that they can be secured together by means of bolts (or pins and rivets). The bolts have the connecting and positioning effects.

In assembling, the above-mentioned three kinds of tube links and end caps are exchangeable, for example, the plastic tube link may be fitted with the metallic end cap, and the metallic tube link may be fitted with the plastic end cap.

Figure 6:
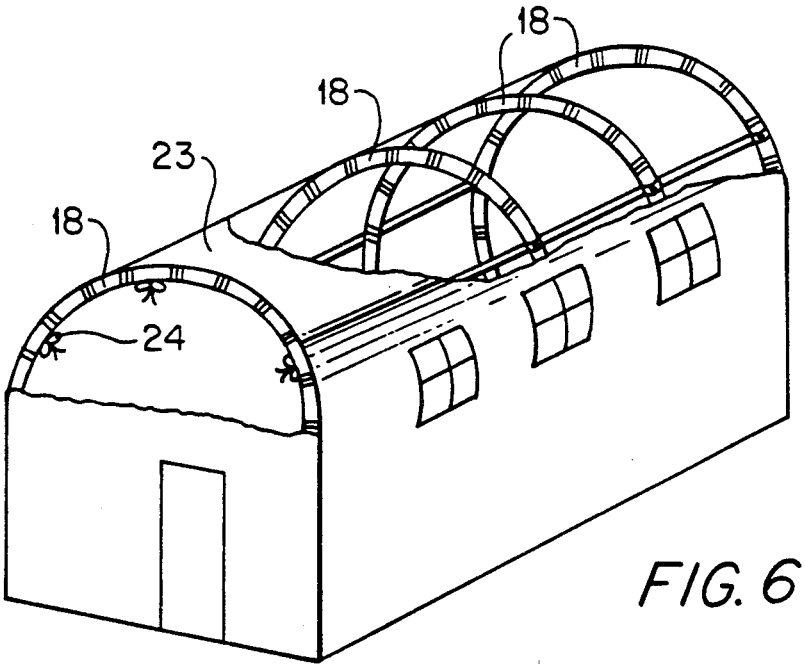
FIG. 6 is a schematic view of an assembled tent.

FIG. 5 shows an assembled backbone-type framework (18) according to the present invention, comprising a plurality of backbone links (10) which are connected in series by a rope (19), a hand winch (20) and a rope-reverser (21), the manual winch (20) is mounted at one end of the framework (18), and the rope reverser (21) is mounted at the other end of the framework (18), one end of the rope (19) is secured to the hand winch (20), the other end of rope (19) passes through the holes (9) on one side of the end caps (2), and passes round the rope reverser (21), then passes back through the holes (9) on the other side of the end caps (2), then the rope end is fixed to the hand winch (20). When the framework is to be assembled, the hand winch (20) is operated to tension the loop-like rope (19), thus, the outer end surfaces (8) of all backbone links (10) are tightly pressed on each other, whereby to form an arched framework (18) (as shown in FIG. 5). A plurality of frameworks (18) may be provided for a tent, depending on the desired size of the tent, then the tarpaulin (23) is fixed to the frameworks (18) by means of the strings (24) (or the like means), thus assembly of the tent is finished, (as shown in FIG. 6).

When the tent is to be disassembled, the rope (19) is released by reversely operating the hand winch (20), thus, the backbone links (10) are separated from each other, and the tent can be folded and transported. To be convenient in maintenance, the backbone links (10) and the tarpaulin (23) may be made as an integral.

Figure 7:
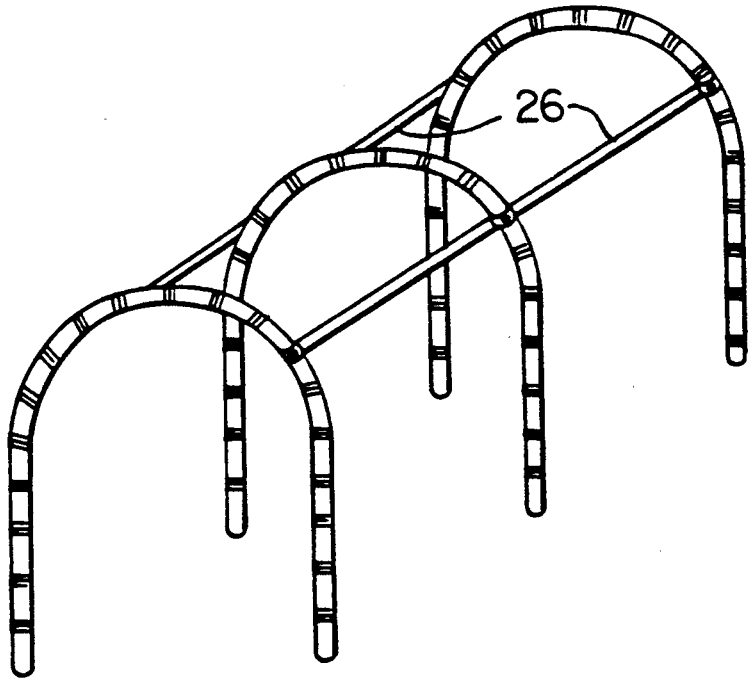
FIG. 7 shows a further embodiment according to the present invention, showing the framework with the transverse levers.

FIG. 7 shows a further embodiment of the framework according to the present invention. There are provided some transversal levers (26) between adjacent frameworks (18), the transversal levers (26) make the tent stabler.

Also said framework (18) can be employed for permanent constructions, such as houses, bridges, etc. In this case, the hand winch will be removed, and all the tube links (1) are bored and filled with resin or other binders, thus, the backbone links (10) and the rope (19) are firmly secured to form a permanent integral.

Framework (18) of various sizes can be built by choosing the length and the number of said backbone links (10).

FIG. 5 shows an embodiment according to the present invention, in which, the framework (18) is in the arch-shape. The angle A between two end surfaces (7, 8) of the end cap (2) may be calculated from the formula:

$$A = \frac{\text{The radiam of the framework}}{\text{The number of links of the framework} - 1}$$

Figure 8:
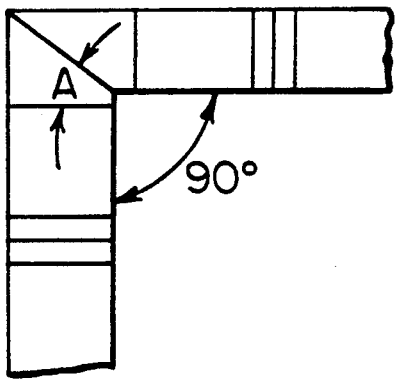
FIGS. 8, 16 and 17 shows several connecting ways of the backbone links according to the present invention.
Figure 9:
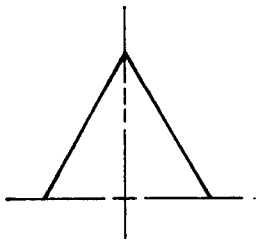
Figure 10:
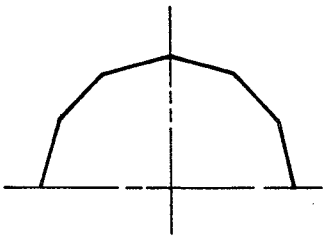
Figure 11:
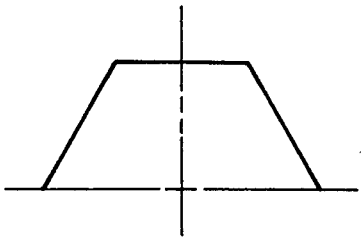
Figure 12:
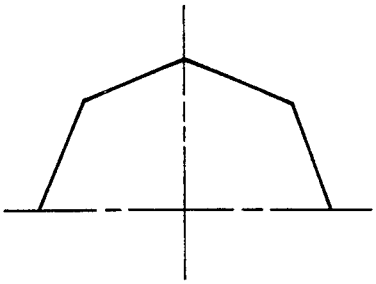
Figure 13:
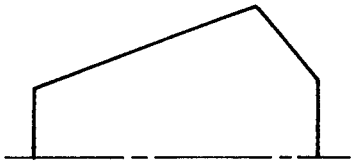
Figure 14:
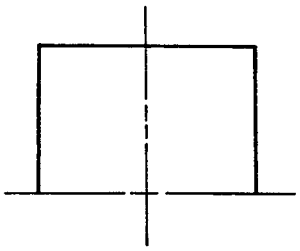
Figure 16:
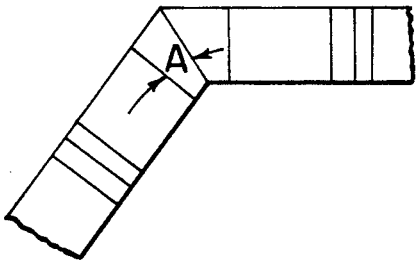
Figure 17:
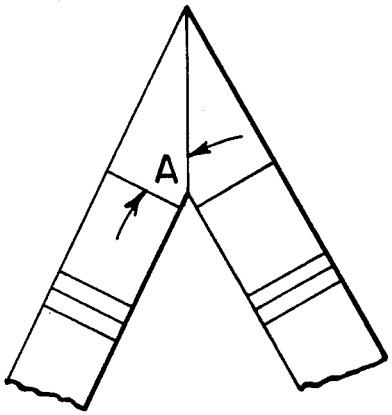

Now referring to FIG. 8, the frameworks of various shapes can be formed by choosing the angle A between two end surfaces (7, 8) of the end plates (5). FIGS. 8-(*a*), (*b*) and (*c*) respectively show the several embodiments where the frameworks are formed with different angles A. FIG. 9 schematically shows some shapes of several frameworks formed by choosing the angle A between two end surfaces (7, 8). The angles A of frameworks of various shapes may be obtained by drawing.

Using the framework of the present invention, the tent, the dismountable house and the permanent construction will have a high space utility, a simple structure, and are convenient to be assembled (or disassembled) and transported. In addition to those mentioned above, the framework according to the present invention may be employed for building agricultural plastic sheds, awnings for the exhibition hall, stadiums and swimming pools.

The backbone-type framework according to the present invention may have a variety of modifications which should be considered within the scope of the present invention.

I claim:

1. A backbone-type framework, characterized in that said framework (18) comprises a rope (19); a plurality of backbone links (10) connected in series by said rope (19); a hand winch (20) located at one end of said framework (18), said rope (19) is connected to said manual winch (20), and can be tensioned or released; and a rope-reverser (21) located at the other end of said framework (18); each of said backbone links (10) comprises a tube link (1) and two end caps (2), said end cap (2) has a tube portion (4) and an end plate (5), said tube portion (4) can be inserted into said tube link (1); the outer end surface (8) of said end plate (5) is oblique, there is an angle A between two end surfaces (7, 8) of said end plate (5); said end plate (5) of said end cap (2) is provided with two holes (9) through which said rope (19) passes, said two holes (9) are spaced from each other at an angle of 180°.

2. The framework according to claim 1, characterized in that said tube portion (4) of said end cap (2) is provided with two grooves (11) extending axially, two grooves (11) are spaced from each other at an angle of 180°, and are positioned at right angle with said two holes (9) of said end plate (5); said tube link (1) is provided on its inner wall with two protrusion portions (3), which extend axially and are spaced from each other at an angle of 180°, said two protrusion portions (3) can engage with two grooves (11) of said end cap (2).

3. The framework according to claim 1, characterized in that said tube portion of said end cap and said tube link are respectively provided with the holes, so that said end cap and said tube link can be secured together by means of bolts.

4. The framework according to claim 1, characterized in that said tube link is provided with the flange (12), said flange (12) is perpendicular to said two protrusion portions (3) of said tube links.

5. The framework according to claim 1, characterized in that said angle A between two end surfaces (7, 8) of said end plates (5) may be choosing to form frameworks of various shapes.

6. The framework according to claim 1, characterized in that the number and the length of said backbone links (10) may be choosing to form frameworks of various sizes.

7. The framework according to claim 1, characterized in that said tube links (1) are made from polypropylene; said end caps (2) are made from ABS.

8. The framework according to claim 1, characterized in that said tube links (1) and said end caps (2) are made from metal.

9. The framework according to claim 1, characterized in that said frameworks (18) and the tarpaulin (or the roof of house) can be made as either an integral, or two separate portions.

* * * * *